US011725471B2

(12) United States Patent
Baugh

(10) Patent No.: US 11,725,471 B2
(45) Date of Patent: Aug. 15, 2023

(54) METHOD FOR RETAINING BLOWOUT PREVENTER ACTUATOR BODIES

(71) Applicant: Benton Frederick Baugh, Houston, TX (US)

(72) Inventor: Benton Frederick Baugh, Houston, TX (US)

( * ) Notice: Subject to any disclaimer, the term of this patent is extended or adjusted under 35 U.S.C. 154(b) by 0 days.

(21) Appl. No.: 17/386,767

(22) Filed: Jul. 28, 2021

(65) Prior Publication Data

US 2023/0032825 A1 Feb. 2, 2023

(51) Int. Cl.
*E21B 33/06* (2006.01)

(52) U.S. Cl.
CPC ..... *E21B 33/062* (2013.01)

(58) Field of Classification Search
CPC ..... E21B 33/062; E21B 33/063
See application file for complete search history.

(56) References Cited

U.S. PATENT DOCUMENTS

| | | | | |
|---|---|---|---|---|
| 4,492,359 | A | 1/1985 | Baugh | |
| 5,897,094 | A * | 4/1999 | Brugman | E21B 33/062 251/1.3 |
| 7,044,430 | B2 * | 5/2006 | Brugman | E21B 33/062 251/1.1 |
| 10,273,774 | B2 | 1/2019 | Jaffrey | |
| 10,767,437 | B2 | 9/2020 | Shimonek | |
| 2013/0264502 | A1 * | 10/2013 | Jahnke | E06B 5/00 251/1.3 |

* cited by examiner

*Primary Examiner* — Daphne M Barry

(57) ABSTRACT

In a blowout preventer central bore and a central bore axis with an oval ram cavity having a ram cavity axis having one or more horizontal interface portions between the ram cavity and an actuator body, a method of connecting the actuator body to the ram cavity comprising providing one or more locking bar receptacles passing through one or more of the planes of the one or more horizontal interface portions of the ram cavity, providing one or more locking bar receptacles passing through one or more of the planes of the one or more horizontal interface portions of the actuator body, and providing one or more locking bars in one or more of the one or more locking bar receptacles in both the ram cavity and the actuator body.

9 Claims, 6 Drawing Sheets

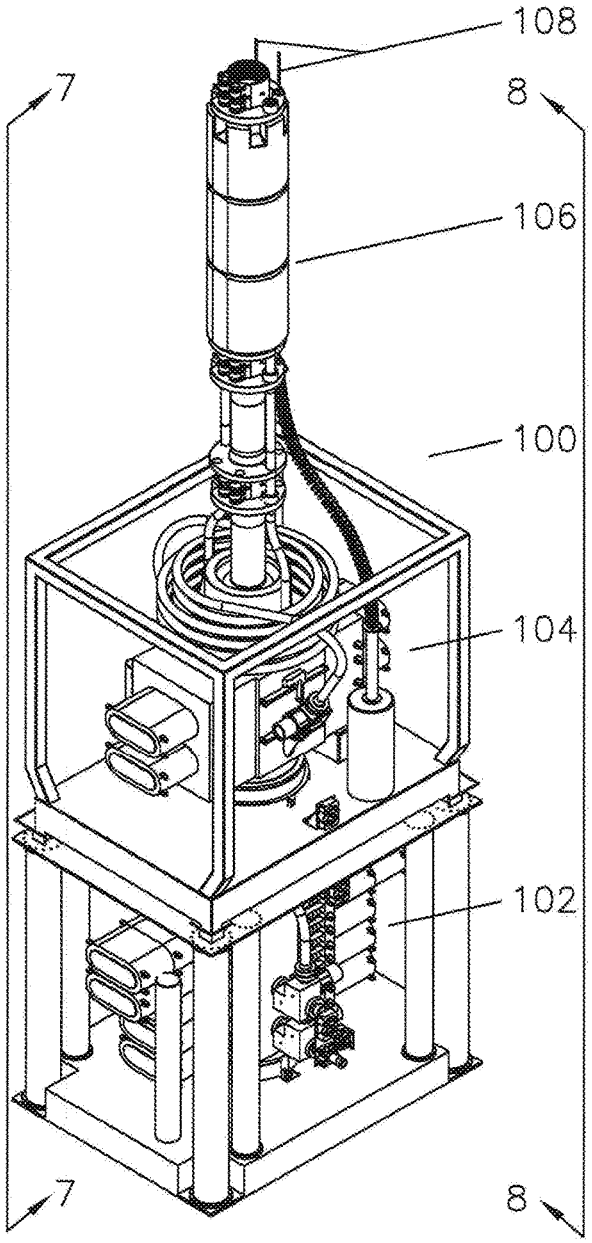
FIG. 2
FIG. 6
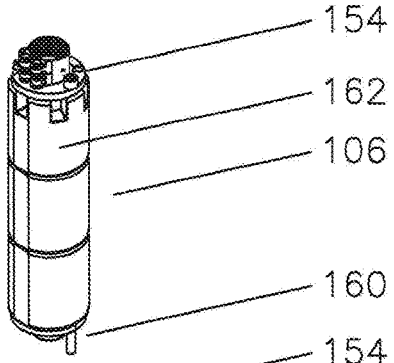
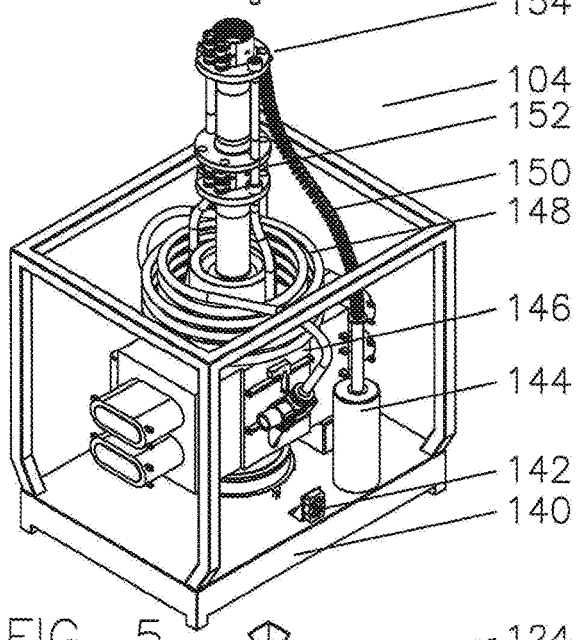
FIG. 5
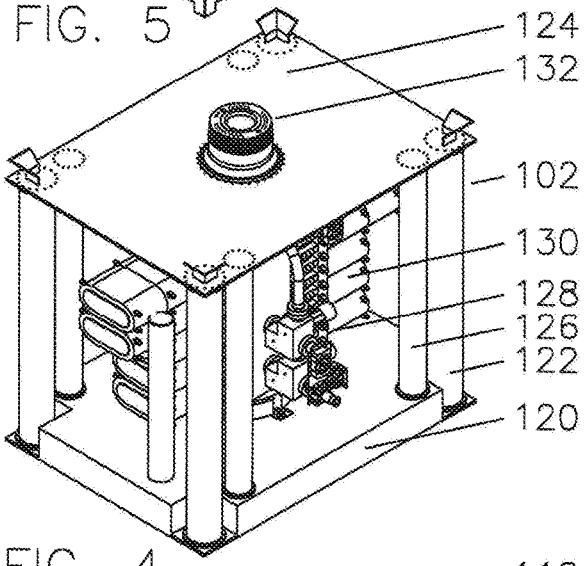
FIG. 4
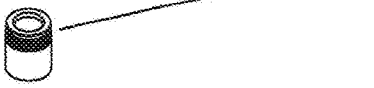
FIG. 3

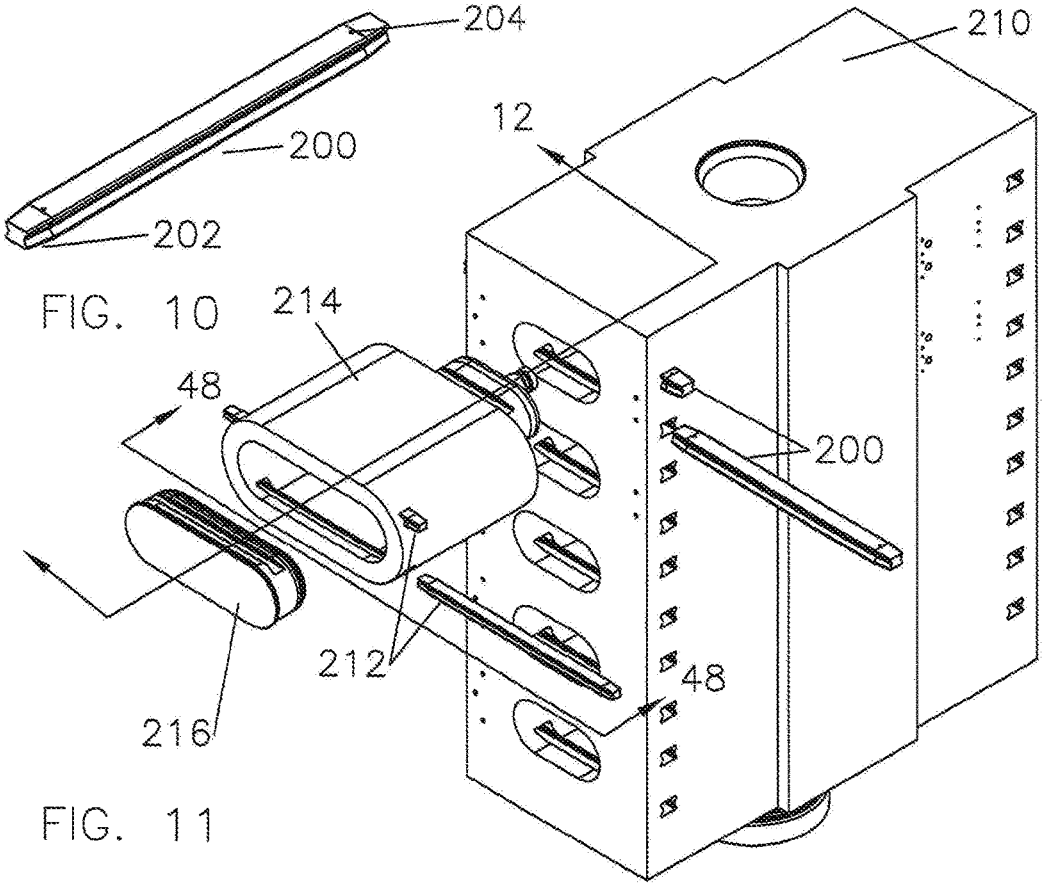
FIG. 10
FIG. 11
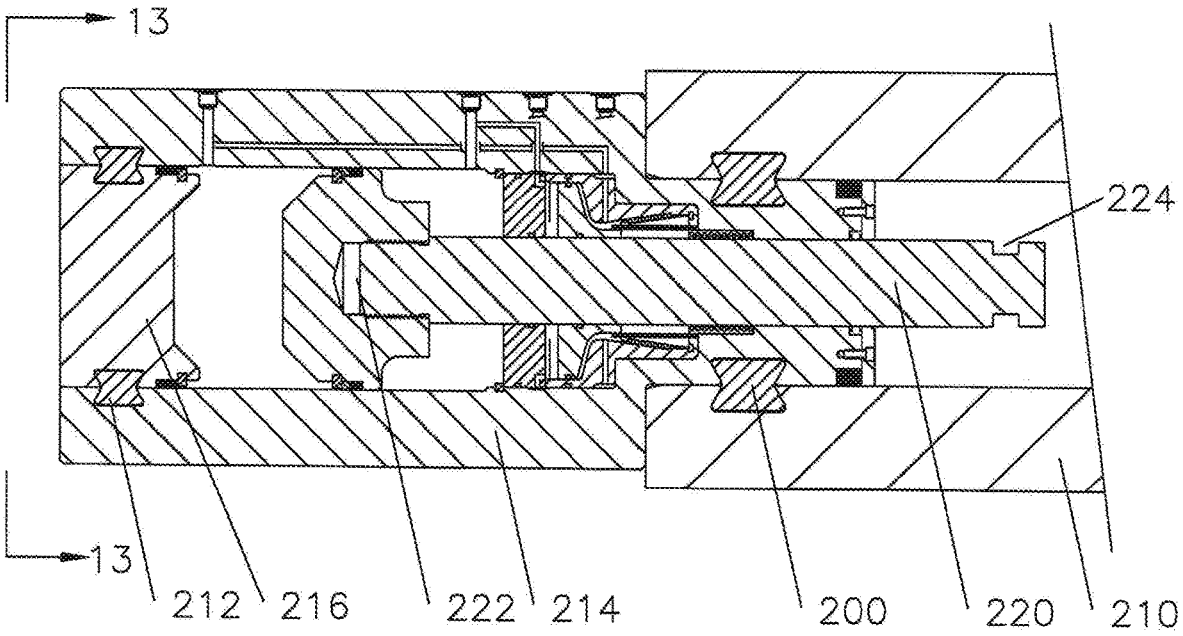
FIG. 12

METHOD FOR RETAINING BLOWOUT PREVENTER ACTUATOR BODIES

TECHNICAL FIELD

This invention relates to the method of providing a retaining method for blowout preventer actuator bodies especially as it applies to 20,000 p.s.i. blowout preventer stacks.

CROSS-REFERENCE TO RELATED APPLICATIONS

Not applicable.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

Deepwater offshore drilling requires that a vessel at the surface be connected through a drilling riser and a large blowout preventer stack to the seafloor wellhead. The seafloor wellhead is the structural anchor piece into the seabed and the basic support for the casing strings which are placed in the well bore as long tubular pressure vessels. During the process of drilling the well, the blowout preventer stack on the top of the subsea wellhead provides the second level of pressure control for the well. The first level being provided by the weighted drilling mud within the bore.

During the drilling process, weighted drilling mud circulates down a string of drill pipe to the drilling bit at the bottom of the hole and back up the annular area between the outside diameter of the drill pipe and the inside diameter of the drilled hole or the casing, depending on the depth.

Coming back up above the blowout preventer stack, the drilling mud will continue to travel back outside the drill pipe and inside the drilling riser, which is much large than the casing. The drilling riser has to be large enough to pass the casing strings run into the well, as well as the casing hangers which will suspend the casing strings. The bore in a contemporary riser will be at least twenty inches in diameter. It additionally has to be pressure competent to handle the pressure of the weighed mud, but does not have the same pressure requirement as the blowout preventer stack itself.

As wells are drilled into progressively deeper and deeper formations, the subsurface pressure and therefore the pressure which the blowout preventer stack must be able to withstand becomes greater and greater. This is the same for drilling on the surface of the land and subsea drilling on the surface of the seafloor. Early subsea blowout preventer stacks were of a 5,000 p.s.i. working pressure, and over time these evolved to 10,000 and 15,000 p.s.i. working pressure. As the working pressure of components becomes higher, the pressure holding components naturally become both heavier and taller. Additionally, in the higher pressure situations, redundant components have been added, again adding to the height. The 15,000 blowout preventer stacks have become in the range of 800,000 lbs. and 80 feet tall. This provides enormous complications on the ability to handle the equipment as well as the loadings on the seafloor wellhead. In addition to the direct weight load on the subsea wellheads, side angle loadings from the drilling riser when the surface vessel drifts off the well centerline are an enormous addition to the stresses on both the subsea wellhead and the seafloor formations.

When the blowout preventer stack working pressure is increased to 20,000 p.s.i. some estimates of the load is that it increases from 800,000 to 1,200,000 lbs. The height also increases, but how much is unclear at this time but it will likely approach 100 feet in height.

A second complication is that a 20,000 p.s.i. working pressure requires a 30,000 p.s.i. test pressure. As the actual stresses in material is greater than the bore pressure, the differential between the actual stress level and the yield strength of the material becomes much narrower. Imagine for a 15,000 p.s.i. component the maximum stress is 32,000 p.s.i. at working pressure and 48,000 p.s.i. at the 22,500 p.s.i. required test pressure. If the best reasonably available material has a 75,000 p.s.i. yield strength at that point you are working with a 1.56/1 factor. If you simply increase the working pressure to 20,000 p.s.i. with a 30,000 p.s.i. test pressure, the stress at test pressure goes to 72,000 p.s.i. which has barely a 1.04/1 safety factor. With the complications of stress analysis, even doubling the weight of the components will not get the stress levels back down to a reasonable level.

Another factor leading to higher and higher blowout preventer stacks is space assigned to adding sufficient bolting to retain the actuator bodies, and then allocating adequate space for wrenches to properly torque the bolts into place. As blowout preventers become larger with bores up to 18 ¾" in diameter and ram cavities whose width must exceed the diameter of the bore the forces carried by the bonnet bolts and the areas they bridge become enormous. The conventional bolting utilized is seen in FIG. 6 of U.S. Pat. No. 4,492,359 and FIG. 2 of U.S. Pat. No. 10,273,774.

BRIEF SUMMARY OF THE INVENTION

The object of this invention is to reduce the size, weight, and complexity of subsea blowout preventer stacks.

A second object of this invention is to provide a rapid makeup of blowout preventer bonnet bolting.

A third object of this invention is to provide a preloaded bonnet connection.

Another object of this invention is to reinforce the blowout preventer body and actuator body against deformation.

BRIEF DESCRIPTION OF THE DRAWINGS

FIG. 2 is a perspective view of a blowout preventer stack utilizing the features of this invention.

FIG. 3 is a perspective view of a subsea wellhead housing which the blowout preventer stack of this invention would land on.

FIG. 4 is a perspective view of the lower portion of the blowout preventer stack of FIG. 2, generally called the lower BOP stack.

FIG. 5 is a perspective view of the upper portion of the blowout preventer stack of FIG. 2, generally called the lower marine riser package or LMRP.

FIG. 6 is a perspective view of a section of the drilling riser which will be used to lower the blowout preventer stack.

FIG. 10 is a perspective view of a locking bar.

FIG. 11 is a perspective view of a blowout preventer body similar to item 130 if FIGS. 7 and 8 with an actuator partially exploded.

FIG. 12 is a cross section of a portion of the blowout preventer taken along lines "12-12".

DETAILED DESCRIPTION OF THE INVENTION

Figure 1:
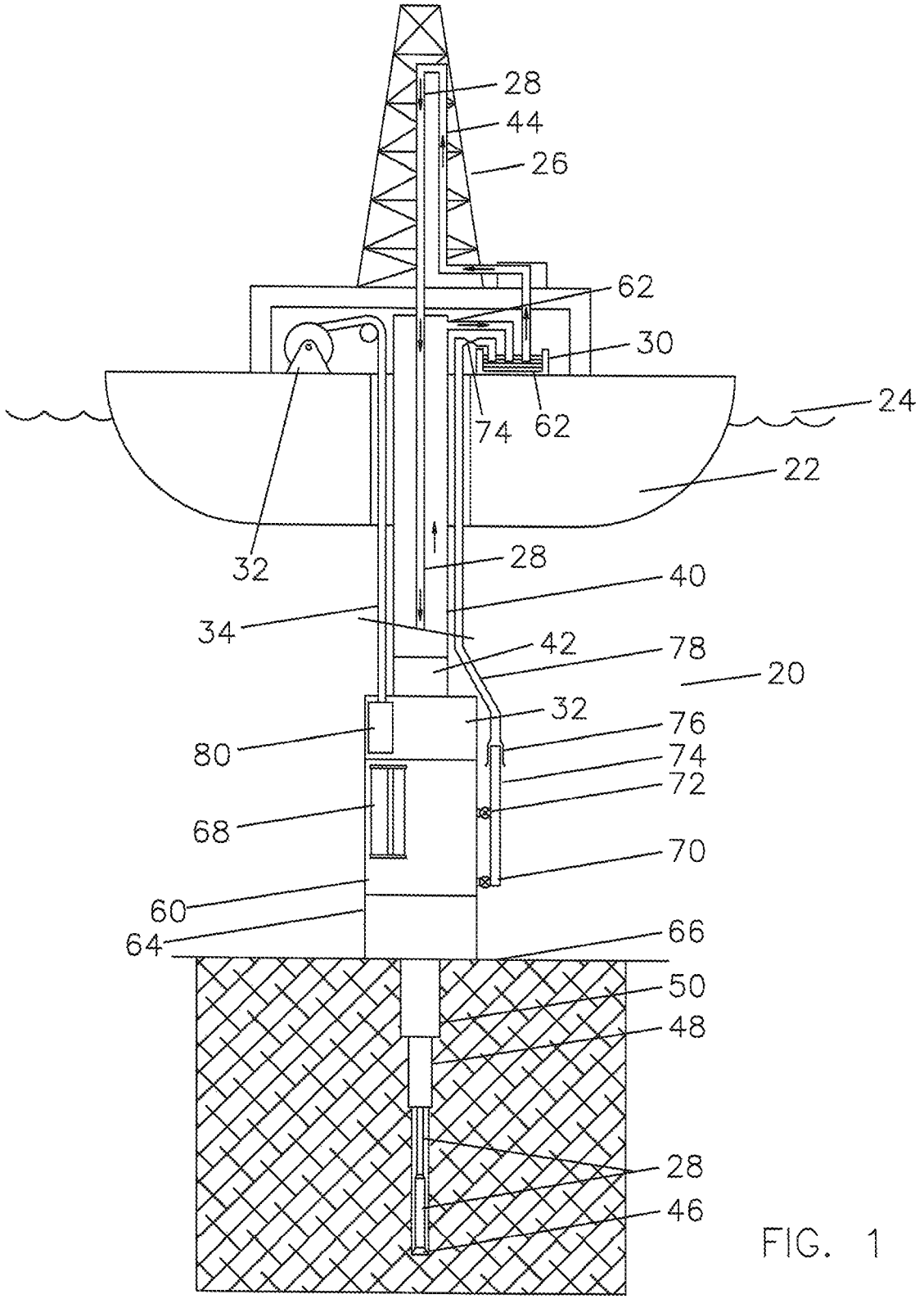
FIG. 1 is a view of a contemporary deep-water riser system.

Referring now to FIG. 1, a view of a system 20 which might use the present invention is shown. It shows a floating vessel 22 on a body of water 24 and having a derrick 26. Drill pipe 28, drilling mud system 30, control reel 32, and control cable 34 are shown. A riser system 40 including a flex joint 42 is shown. During drilling the drilling mud circulated from the drilling mud system 30, up the standpipe 44, down the drill pipe 28, through the drill bit 46, back up through the casing strings 48 and 50, through the blowout preventer stack 60, up thru the riser system 40, and out the bell nipple at 62 back into the mud system 30.

Blowout preventer stack 60 is landed on a subsea wellhead system 64 landed on the seafloor 66. The blowout preventer stack 60 includes pressurized accumulators 68, kill valves 70, choke valves 72, choke and kill lines 74, choke and kill connectors 76, choke and kill flex means 78, and control pods 80.

Referring now to FIG. 2, the seafloor drilling system 100 comprises a lower blowout preventer stack 102, a lower marine riser package 104, a drilling riser joint 106, and control cables 108.

Referring now to FIG. 3, a subsea wellhead is shown which the seafloor drilling system lands on. It is the unseen upper portion of the subsea wellhead system 64 shown in FIG. 1.

Referring now to FIG. 4, the lower blowout preventer stack 102 comprises a lower structural section 120, vertical support bottle 122, and upper structural section 124, accumulators 126, choke and kill valves 128, blowout preventers 130 and an upper mandrel 132 which will be the connection point for the lower marine riser package.

Referring now to FIG. 5 the lower marine riser package 104 is shown comprising a lower marine riser package structure 140, an interface 142 for a remotely controlled vehicle (ROV), annular blowout preventers 146, choke and kill flex loops 148, a flexible passageway 150, a riser connector 152, and an upper half of a riser connector 154.

Referring now to FIG. 6, a drilling riser joint 106 is shown having a lower half of a riser connector 160, a upper half of a riser connector 154, and buoyancy sections 162.

Figure 7:
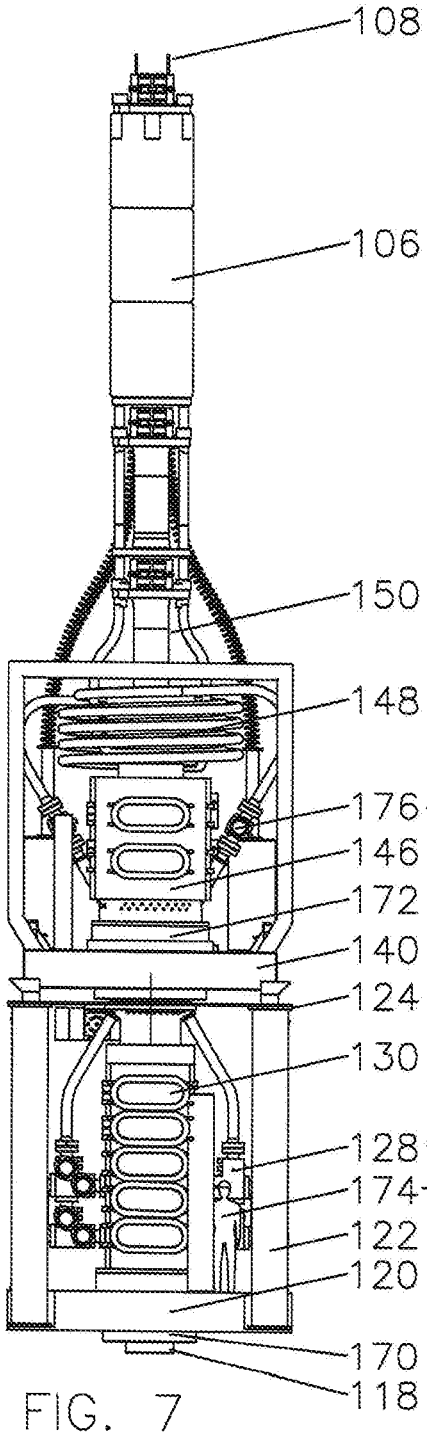
FIG. 7 is a view of the blowout preventer stack of FIG. 2, taken along lines "7-7.

Referring now to FIG. 7, is a view of seafloor drilling system 100 taken along lines "7-7" of FIG. 1 showing wellhead connector 170, lower marine riser connector 172, a man 174 for size perspective, and choke and kill valves 176.

Figure 8:
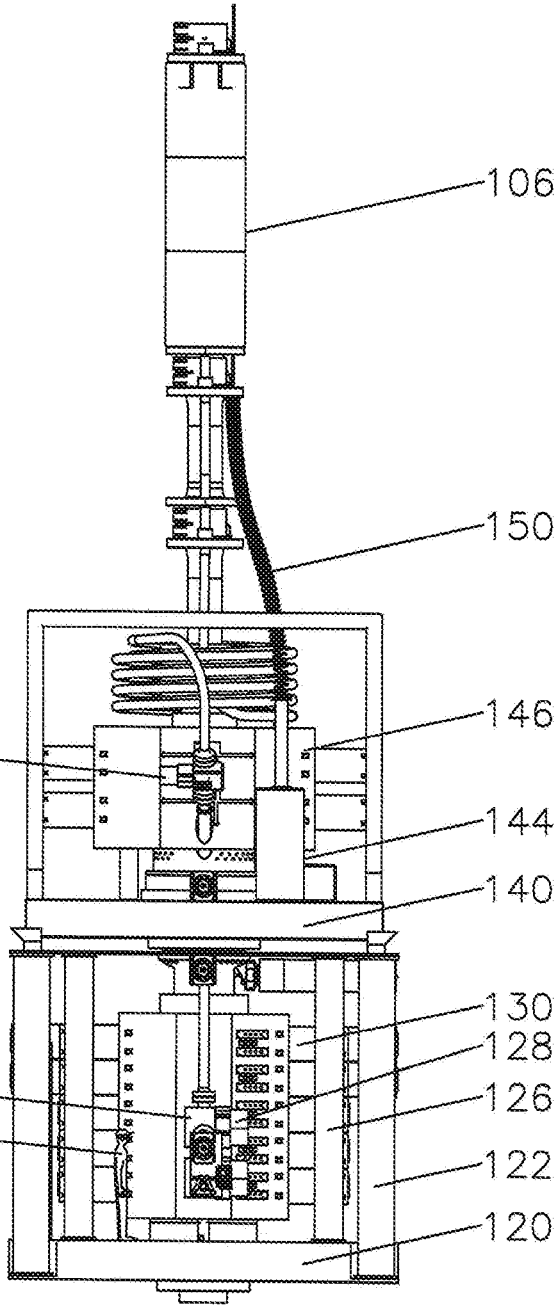
FIG. 8 is a view of the blowout preventer stack of FIG. 2, taken along lines "8-8.

Referring now to FIG. 8, is a view of seafloor drilling system 100 taken along lines "8-8" of FIG. 1.

Figure 9:
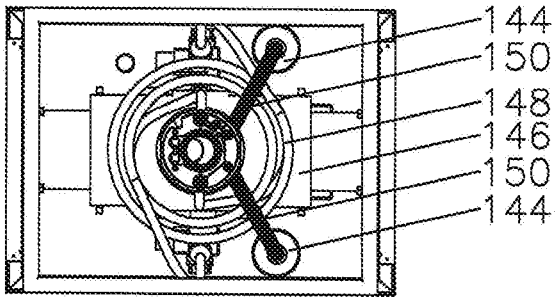
FIG. 9 is a top view of FIG. 8.

Referring now to FIG. 9, is a top view of seafloor drilling system 100.

Referring now to FIG. 10 a much simpler bonnet retention means is shown in perspective as locking bar 200. It can be utilized in a square, rectangular, hexagon, round, "X" or other shape, with the "X" shape being described herein. Locking bar 200 provides tapered ends 202 for easy insertion and has a hole 204 on each end for retaining in place. The locking bar 200 shape can be straight for easy insertion, tapered for a snug fit, or made of multiple tapered parts for easy insertion and then expansion to a snug fit once inserted.

Referring now to FIG. 11, a first locking bar 200 is shown being inserted into a similarly shaped receptacle in blowout preventer body 210 and a second locking bar 200 is shown completely installed. Similarly a first locking bar 212 is shown being inserted into a similarly shaped receptacle in actuator body 214 and a second locking bar 212 is shown completely installed. It can readily seen that both the locking bar 200 and the locking bar 212 provide large areas in shear to retain the bonnet 214 and the bonnet end cap 216 rather than the limited circular diameter of bolting which might be utilized otherwise.

Referring back to FIGS. 7 and 8 it can be noted that by utilizing this bonnet connection method, the actuators can be placed right next to each other rather than requiring both added vertical and horizontal spacing to allow for the makeup of bolting. As every inch of height and length provide actual cost, weight addition, and extra handling cost on this type equipment.

Referring now to FIG. 12, a cross section generally taken along lines "12-12" of FIG. 11 (unexploded) is shown with the piston rod 220, piston 222, profile on the end of the piston rod 224 for engaging the rams.

Figure 13:
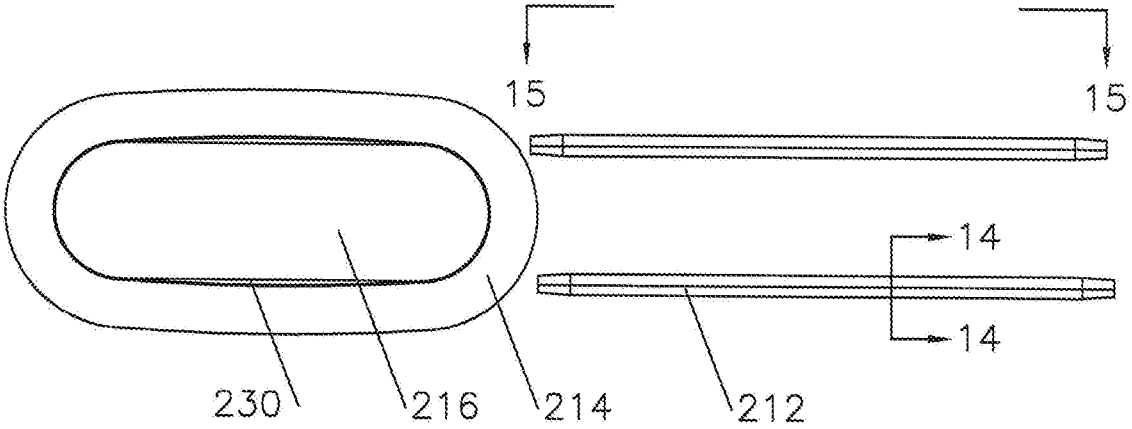
FIG. 13 is an end view of an actuator taken along lines "13-13" of FIG. 12.

Referring now to FIG. 13 which is generally taken along lines "13-13" of FIG. 12 showing the end of the actuator body 214 and the bonnet end cap 216 with the locking bar 212 approaching. It will be noted that both the piston 222, the bonnet end cap 216 and the actuator body 214 are in the form of a "race track" oval, as the ram cavities are. This is to gain a greater piston area than would be available in the spacing using a simple circular piston. It will be noted that at the pressures required to operate these blowout preventers, the center of the "race track" oval actuator body 214 will tend to be deflect and produce a gap 230 with the piston 222 and the bonnet end cap 216.

Figure 14:
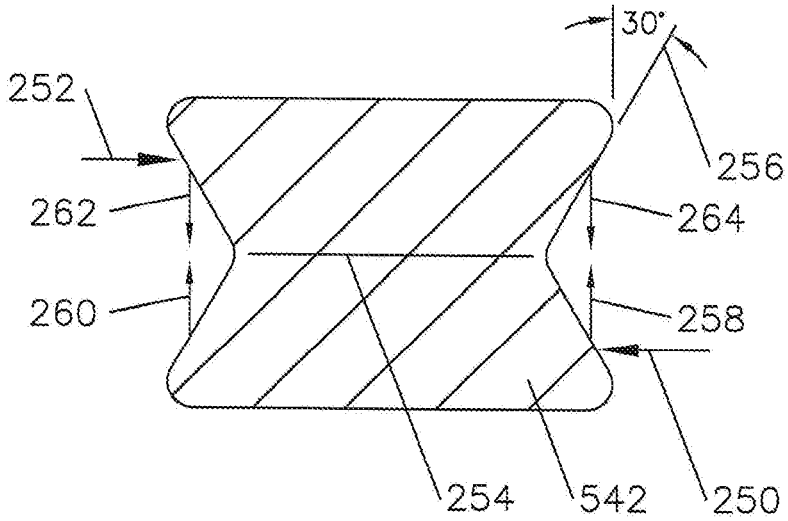
FIG. 14 is a cross section of FIG. 13 taken along lines "14-14" of FIG. 13 showing loadings imparted to the actuator bar.

Referring now to FIG. 14 which is a cross section of locking bar 212 taken along lines "14-14" of FIG. 13 showing that the pressure force 250 of the pressurized fluids in the system will be restrained by a mechanical force 252, generally causing a shear stress in the shear plane 254. The length of shear plane 254 can be made as long as required to reduce the shear stresses to an acceptable level. It can also be noted that due to the angle 256 which is shown to be 30° forces 250 and 252 generate forces 258-264 which restrain the deflection in the actuator body 214 which produced the gap 230 therefore making the seals sealing within the actuator body 214 more reliable. The same will be true of the locking bar 200 and the blowout preventer body 210. In this case the wall thicknesses are much thicker to minimize deflection, but the pressures sustained to cause deflection are also considerably higher. Typically the actuator body will see pressures in the range of 3,000 to 5,000 p.s.i. and the blowout preventer bodies will see pressures in the range of 5,000 to 20,000 p.s.i.

Figure 15:
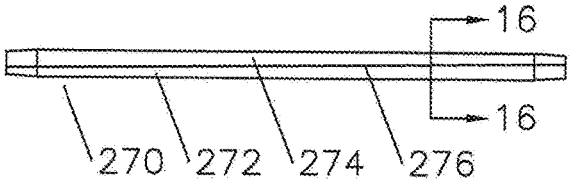
FIG. 15 a top view of an locking bar taken along lines "15-15" of FIG. 13.

Referring now to FIG. 15 which is taken along lines "15-15" of FIG. 13, a top view of a locking bar 270 is shown being made of two pieces 272 and 274 with an angled interface at 276. Each of these pieces are tapered such that after being pushed into a mating profile, they can be move one relative to the other to expand their width and remove all "play" or movement within the mating profile. If pressed hard enough they can be fully preloaded to any force expected to be experienced.

Figure 16:
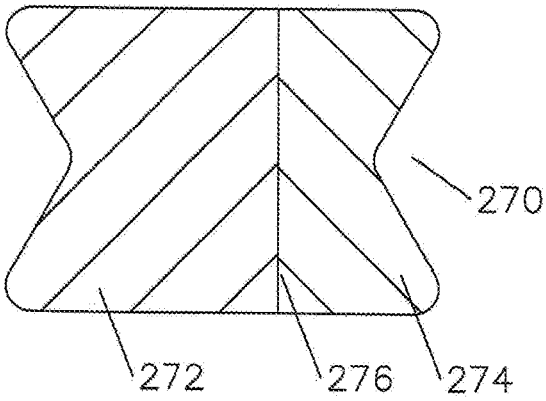
FIG. 16 is a cross section of the locking bar of FIG. 15 taken along lines "16-16".

Referring now to FIG. 16 which is taken along lines "16-16" of FIG. 15, it can be seen that the profile is similar to the profile in FIG. 14 and that the length of the load supporting shear plane has not been reduced. In fact the length of the shear plane has been slightly increased as there is no gap between locking bar 270 and the mating profile.

Figure 17:
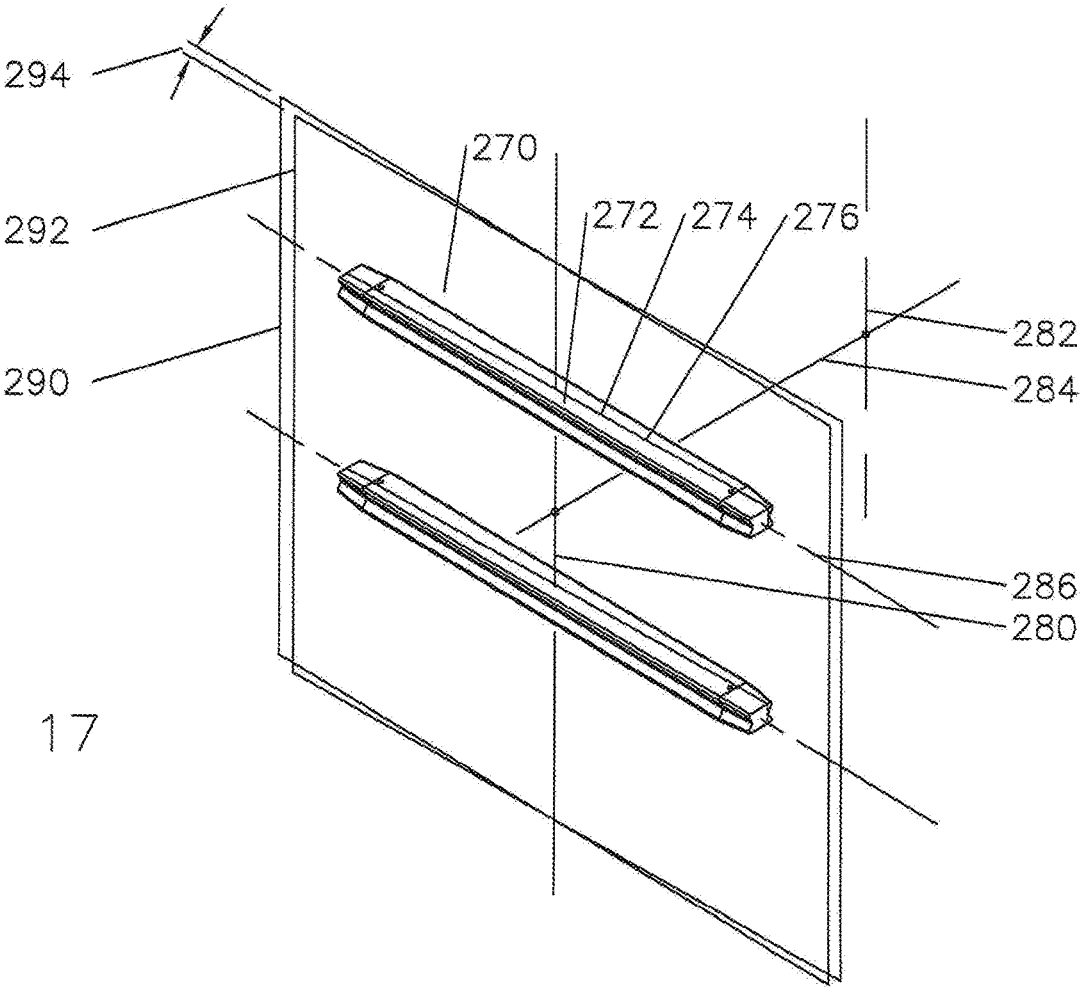
FIG. 17 is a perspective view of two locking bars defining the plane separating to parts of a locking bar.

Referring now to FIG. 17 rotational axis 280 is parallel to central bore axis 282 and passes through both ram cavity axis 284 and locking bar axis 286. Plane 290 is defined by rotational axis 280 and locking bar axis 286. Plane 292 shown in dashed lines is rotated from plane 290 about rotational axis 280 at angle 294. Interface 276 is in plane 292.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

That which is claimed is:

1. A method of connecting the actuator body to the ram cavity in a blowout preventer having central bore and a central bore axis with an oval ram cavity having a ram cavity axis having one or more horizontal interface portions between the ram cavity and an actuator body, a method of connecting the actuator body to the ram cavity comprising providing one or more locking bar receptacles passing through one or more of the planes of the one or more horizontal interface portions of the ram cavity, providing one or more locking bar receptacles passing through one or more of the planes of the one or more horizontal interface portions of the actuator body, providing one or more locking bars in one or more of the one or more locking bar receptacles in both the ram cavity and the actuator body, and the one or more locking bar receptacles are proximately flat on a top and bottom and sloping inwardly on at least one side proximate a top corner and proximate a bottom corner to an intersection proximate a middle.

2. A method of connecting the actuator body to the ram cavity in a blowout preventer having central bore and a central bore axis with an oval ram cavity having a ram cavity axis having one or more horizontal interface portions between the ram cavity and an actuator body, a method of connecting the actuator body to the ram cavity comprising providing one or more locking bar receptacles passing through one or more of the planes of the one or more horizontal interface portions of the ram cavity, providing one or more locking bar receptacles passing through one or more of the planes of the one or more horizontal interface portions of the actuator body, providing one or more locking bars in one or more of the one or more locking bar receptacles in both the ram cavity and the actuator body, and the one or more locking bars are proximately flat on a top and bottom and sloping inwardly on at least one side proximate a top corner and proximate a bottom corner to an intersection proximate a middle.

3. The method of claim 2 further providing the locking bar having a locking bar axis and an inner locking bar segment and an outer locking bar segment which have an interface between them which is in a plane at a first angle about a first axis parallel to the central bore axis which passes through the locking bar axis and the ram cavity axis, and moving the inner locking bar segment relative to the outer locking bar segment to preload the actuator body with the ram cavity to restrain the deflection in the actuator body.

4. The method of claim 3 further providing the moving the inner locking bar segment relative to the outer locking bar segment to preload the actuator body with the ram cavity in a linear movement.

5. A method of connecting the actuator body to the ram cavity in a blowout preventer having central bore and a central bore axis with an oval ram cavity having a ram cavity axis having one or more horizontal interface portions between the ram cavity and an actuator body, a method of connecting the actuator body to the ram cavity comprising providing one or more locking bar receptacles passing through one or more of the planes of the one or more horizontal interface portions of the ram cavity, providing one or more locking bar receptacles passing through one or more of the planes of the one or more horizontal interface portions of the actuator body, providing one or more locking bars in one or more of the one or more locking bar receptacles in both the ram cavity and the actuator body, and two one or more locking bar opposing sides approximate the shape of an "X".

6. The method of claim 5 further providing the locking bar having a locking bar axis and an inner locking bar segment and an outer locking bar segment which have an interface between them which is in a plane at a first angle about a first axis parallel to the central bore axis which passes through the locking bar axis and the ram cavity axis, and moving the inner locking bar segment relative to the outer locking bar segment to preload the actuator body with the ram cavity to restrain the deflection in the actuator body.

7. The method of claim 6 further providing the moving the inner locking bar segment relative to the outer locking bar segment to preload the actuator body with the ram cavity in a linear movement.

8. The method of claim 5 further providing the locking bar having a locking bar axis and an inner locking bar segment and an outer locking bar segment which have an interface between them which is in a plane at a first angle about a first axis parallel to the central bore axis which passes through the locking bar axis and the ram cavity axis, and moving the inner locking bar segment relative to the outer locking bar segment to preload the actuator body with the ram cavity to restrain the deflection in the actuator body.

9. The method of claim 8 further providing the moving the inner locking bar segment relative to the outer locking bar segment to preload the actuator body with the ram cavity in a linear movement.

* * * * *